US006471210B1

(12) United States Patent
Goldman et al.

(10) Patent No.: US 6,471,210 B1
(45) Date of Patent: Oct. 29, 2002

(54) METHOD OF PLAYING A CASINO CARD GAME WITH BONUS BASED ON POSITIONING

(76) Inventors: Arthur Goldman, 5149 N. LaCrosse, Chicago, IL (US) 60630; Jack Goldman, 5149 N. LaCrosse, Chicago, IL (US) 60630

( * ) Notice: Subject to any disclaimer, the term of this patent is extended or adjusted under 35 U.S.C. 154(b) by 0 days.

(21) Appl. No.: 09/912,728

(22) Filed: Jul. 24, 2001

(51) Int. Cl.[7] ..... A63F 1/00
(52) U.S. Cl. ..... 273/292
(58) Field of Search ..... 273/292, 274, 273/309; 463/12, 13

(56) References Cited

U.S. PATENT DOCUMENTS 5,876,283 A * 3/1999 Parra et al. ..... 463/12
5,882,259 A * 3/1999 Holmes, Jr. et al. ..... 463/13
6,004,205 A * 12/1999 Lauretta et al. ..... 463/11
6,336,857 B1 * 1/2002 McBride ..... 463/12

* cited by examiner

*Primary Examiner*—Benjamin H. Layno
(74) *Attorney, Agent, or Firm*—Townsend and Townsend and Crew LLP

(57) ABSTRACT

A method of playing a card game that includes providing a deck of playing cards, assigning a position value to positions at a playing area, dealing a predetermined number of cards to at least one player at least one pre-selected position, and determining if a player is entitled to a bonus payment based upon at least one dealt card matching at least one assigned position value. Alternatively, bonus values are determined based upon cards dealt to the dealer as opposed to being based upon playing positions.

40 Claims, 2 Drawing Sheets

METHOD OF PLAYING A CASINO CARD GAME WITH BONUS BASED ON POSITIONING

BACKGROUND OF THE INVENTION

1. Field of the Invention

The present invention generally relates to a game of chance that can be played in a casino, and more particularly, to modified versions of blackjack and poker.

2. Description of the Prior Art

Blackjack and poker are very popular card games. While blackjack has become extremely popular in casinos, for one reason or another, it has been difficult to adapt the rules of poker to a casino table game in which each player plays against the house. Electronic blackjack and poker machines exist; in the poker versions, players win on achieving certain predetermined hands.

Casinos have become extremely popular and are becoming more numerous in number. Thus, casinos compete for patrons. Accordingly, casinos attempt to lure patrons with more entertaining games and the potential for winning larger amounts of money in the form of bonuses and jackpots. Unfortunately, it is often difficult to modify blackjack and poker in order to provide the opportunity to win such bonuses and jackpots.

BRIEF SUMMARY OF THE INVENTION

The present invention provides a method of playing a card game that includes providing one or more decks of playing cards, assigning a position value to positions at a playing area wherein each position value is unique at each position, dealing a predetermined number of cards to at least one player at at least one pre-selected position, and determining if a player is entitled to a bonus payment based upon at least one dealt card matching at least one assigned position value.

In accordance with one aspect of the present invention, each position value is based upon a sequential position at the playing area.

In accordance with another aspect of the present invention, each position is assigned first and second position values based upon the sequential position, and a player wins a maximum bonus if the player is dealt a first pair of cards and each card matches the first position value, and if the player is dealt a second pair of cards and each card matches the second position value.

In accordance with a further aspect of the present invention, the card game is blackjack-style game and a first pair of cards corresponds to a first hand and a second pair of cards corresponds to a second hand.

In accordance with yet another aspect of the present invention, a first position has a first position value of ace and a second position value of 2, a second position has a first position value of 3 and a second position value of 4, a third position has a first position value of 5 and a second position value of 6, a fourth position has a first position value of 7 and a second position value of 8, a fifth position has a first position value of 9 and a second position value of 10, and a sixth position has a first position value of one of jack, queen, or king, and a second position value of jack, queen or king.

In accordance with yet a further aspect of the present invention, the game is a poker-style game.

In accordance with yet another aspect of the present invention, a player wins a maximum bonus if the player is dealt a first hand and up to four of the cards matches the player's corresponding first position value, and the player is dealt a second hand and up to four of the cards of the second hand match the player's corresponding second position value.

In accordance with alternative embodiments of the present invention, bonus values are determined based upon the cards dealt to the house and bonuses are determined based upon cards dealt to players matching the bonus cards.

Other features and advantages of the present invention will be understood upon reading and understanding the detailed description of the exemplary embodiments found herein below in conjunction with reference to the drawings, in which like numerals represent like elements.

DESCRIPTION OF SPECIFIC EXEMPLARY EMBODIMENTS

The present invention provides a casino card game wherein players may earn bonuses based upon their cards matching certain values. The game is ideally suited for blackjack and poker and the numerous variations thereof.

Figure 1:
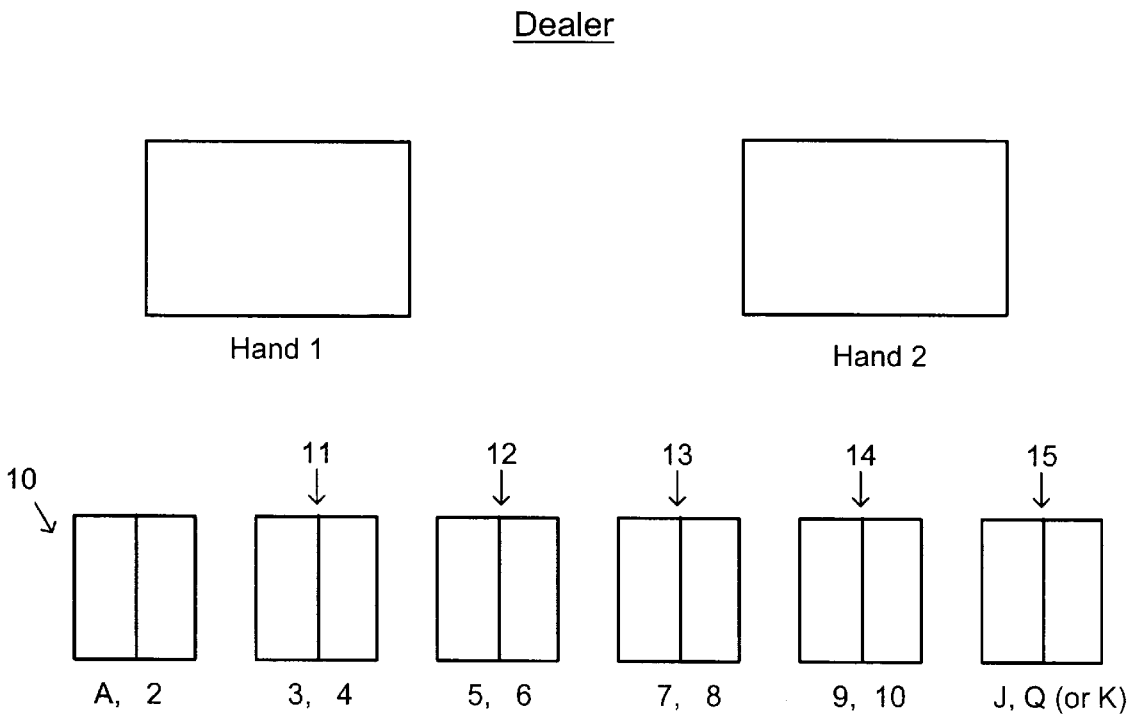
FIG. 1 is a schematic illustration of a layout for a card game in accordance with the present invention.

In a first embodiment of the present invention, the values of cards that a player needs to match are determined based upon the positions around the playing table. Thus, with reference to FIG. 1, a playing table that has, for example, six positions, is assigned position values. Preferably, the position values are sequential such that position 10 is assigned a position value of 1 (ace) and a second position value of 2. Likewise, position 11 is assigned position values of 3 and 4, position 12 is assigned position values of 5 and 6, position 13 is assigned values of 7 and 8, and position 14 is assigned position values of 9 and 10. Position 15 is assigned position values of two of jack, queen, and king.

Those skilled in the art will understand that only one position value needs to be assigned to each position if it is desired. The game may thus be altered to include more (or less) playing positions and more (or less) playing cards. For example, the game may be a blackjack style game wherein multiple deck "shoes" are used to provide playing cards to the players. It may be a poker-style game where players receive two or more cards. Most common poker games require five or seven cards.

In the embodiment described above, players will play two hands, simultaneously, at each playing position. The dealer may play a first hand and a second hand to compete with the player's first and second hands, or the dealer may have one hand that competes against both of the player's hands.

Preferably, in order to qualify for a bonus based upon the position value, a side bet or ante needs to be placed in addition to the player's wager for each hand. The dealer then deals the cards, preferably one at a time to each hand sequentially (or alternatively, two at a time to each hand). The dealer then determines if a player's cards match their position values. If so, bonuses are paid to the players. The bonuses may be predetermined or may consist of progressive jackpots, especially for the "top" prize. Additionally, the bonuses may be, for example, merchandise, complimentary meals, rooms, etc.

Such a top prize preferably involves a player who has placed side bets for both hands and who has received two cards to match his first position value and two cards that match the second position value.

Those skilled in the art will understand that various combinations may be used to provide bonuses or jackpots to players. For example, a player may qualify for a bonus if two cards match one corresponding position value and one or more cards match the second corresponding position value. The player may also qualify for a bonus if one or more cards in their first hand match their corresponding first position value and one or more cards in a second hand match their second corresponding position value. Likewise, a bonus may be paid if a player has one or more cards that match one corresponding position value. Obviously, the lower combinations will occur more frequently and thus, the player will preferably qualify for smaller bonuses.

Preferably, the player must receive the corresponding cards for the corresponding position values in the appropriate hand, i.e., the player's first hand must contain the card(s) having the first position value. However, casinos may decide to not limit the payment of bonuses in such a manner if they so desire.

After the bonuses have been determined, play preferably occurs in a manner consistent with blackjack rules (depending on the version or the house rules) or the poker rules if it is so desired. If it is poker, the remaining cards to complete a player's initial hand(s) need to be dealt if the bonus is based upon fewer cards than needed for the player's hand(s).

Alternatively, bonuses may be paid based upon cards present in the completed hand(s). For example, in blackjack a player may need a pair of threes for a bonus. The player may be dealt a ten and a three. If the player takes another card and it is a three, he may still win a bonus if the casino operating the game desires.

The game may also be played on an electronic game, including a gaming machine. In such an instance, there may not be a "dealer" but there is generally a house hand(s) that a player attempts to defeat or a hand value that a player attempts to achieve. The dealer may play with the player or against the player.

Figure 2:
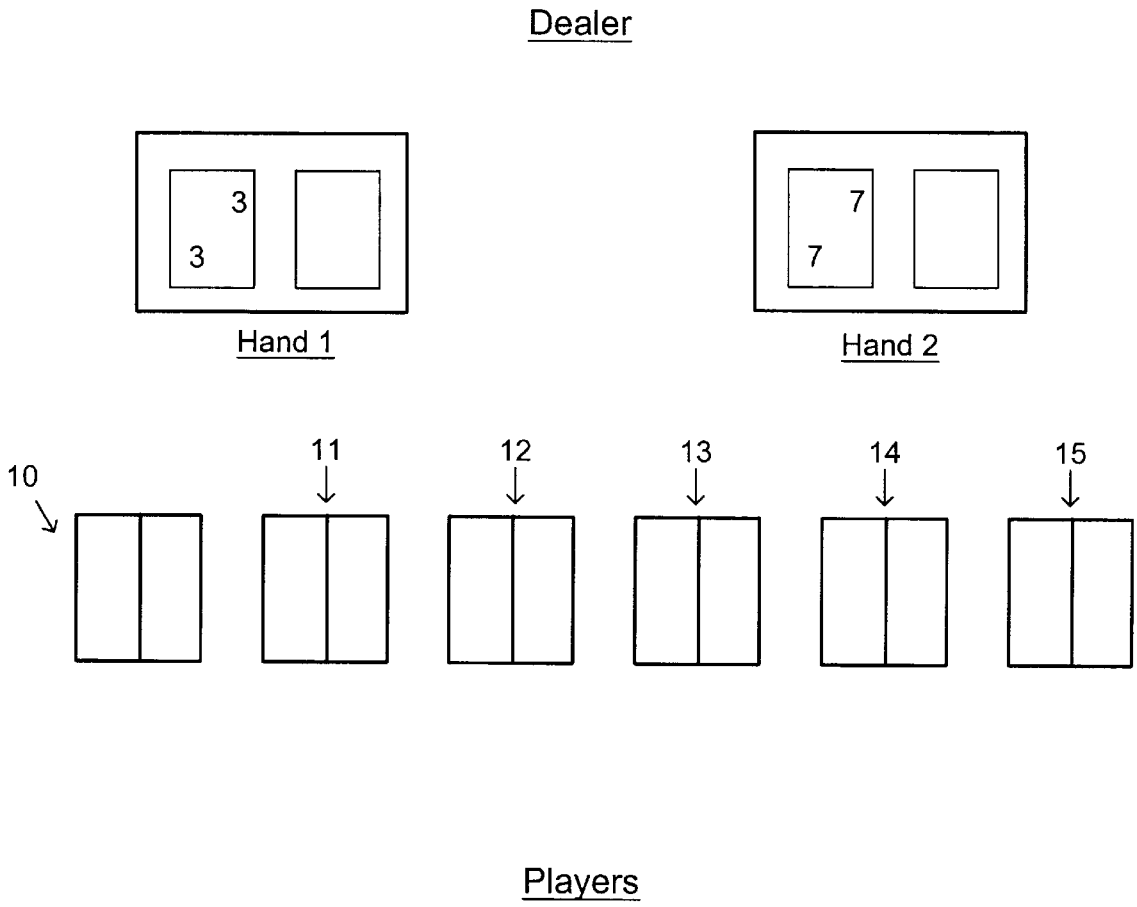
FIG. 2 is a schematic illustration of an alternative embodiment of a casino card game in accordance with the present invention.

In another embodiment, bonus values are assigned based upon the dealer (or house) cards received as opposed to playing positions as shown in FIG. 2. For example, in blackjack, a dealer is dealt two cards, one of which is an "up" card and thus revealed to the player. This up-card, in the alternative embodiment, is used to determine the bonus value. In a preferred embodiment, the dealer is dealt two hands and thus receives two up-cards in blackjack games. Once again, players preferably play two hands and thus, win bonuses based upon their initial two cards matching the corresponding dealer's up-card. Alternatively, the dealer may only have one hand that is played against the player's hand(s) and thus, bonuses are determined on the single up-card. The dealer may also receive both cards of his hand(s) as up-cards if desired or any combination thereof if more than one hand is played. Additionally, dealer down-cards may be used to determine, either alone or in combination with up-cards, to determine bonus values.

In a poker style game, those skilled in the art will understand in that up to four cards may be required to match the position value (or the bonus value set by the dealer's cards) in order to win a bonus. Thus, in instances where players play two hands simultaneously, a person sitting at, for example, the first position (thus having position values of ace and two, respectively) may win a maximum bonus if the players first hand has four aces and the person's second hand has four two's. Once again the bonus may be a progressive jackpot or a fixed amount, depending upon the house rules.

Cards may be dealt in any combination from one at a time up to an entire hand at once. Automatic shufflers may be used. Also, preferably one or more standard 52 card decks are used. However, other decks may be used if desired. For example, jokers and/or wild cards may be included in the deck(s) of cards.

Various combinations of cards may be used to determine a bonus amount. For example, if the person once again is sitting at the first position, they may win a bonus with two aces in the first hand and three twos in the second.

Once again, the dealer may also play two hands simultaneously or may have one hand that plays against both hands of each player. Also, the game may be played on an electronic gaming machine (such as video poker) where players, in addition to trying to earn bonuses, try to attain certain predetermined hands. There also need not be a dealer or "house" hand, i.e., a card room-style arrangement.

Hands may also be made up where the dealer's cards are counted in the player's hands, i.e., a player has three fours and the dealer has a pair of sixes. The player is deemed to have a full house. Also, the poker-style game may be stud or draw.

As with the description above, instead of position values, the poker game may be played where bonus values are determined based upon cards dealt to the dealer. Thus, such a game preferably uses multiple decks since if the dealer were dealt four fours, and a single deck were used, then the player would have no chance of attaining any fours to match the dealer.

In video versions of a game in accordance with the present invention, if position values are used to determine requirements for a bonus, the player would generally pick the position or positions they wish to play. Also, as noted above, the position values are not required to be sequentially determined. Additionally, the matching cards used to determine the qualification for a bonus may be required to be in the first hand and the second hand, may be in either hand, or may even be allowed to be combined by the two hands.

Those skilled in the art will understand that games using any number of cards in a hand may be played that use the present invention of awarding bonuses based upon matching cards. Additionally, players may receive bonuses if it is not their hand but someone else's whose cards match the appropriate bonus values. This may promote camaraderie among players at a table.

Having described specific exemplary embodiments of the invention with reference to the accompanying drawings, it is to be understood that the invention is not limited to those precise embodiments and that various changes and modifications may be effected therein by one skilled in the art without departing from the scope or spirit of the invention as defined in the appended claims.

What is claimed is:

1. A method of playing a card game, the method comprising the steps of:

providing a playing area having a plurality of positions;

providing at least one deck of playing cards;

assigning a position value to each position at the playing area, wherein each position value is unique at each position, said deck of playing cards having at least one card with indicia matching a position value, wherein each position having a corresponding matching card;

dealing an initial predetermined number of cards to at least one player at at least one preselected position, wherein a predetermined number of cards are dealt to each position occupied by a player; and determining if a player is entitled to a bonus based upon at least one initially dealt card dealt to the player matching at least one assigned position value at the player's position.

2. A method in accordance with claim 1 wherein each position value is based upon a sequential position at the playing area.

3. A method in accordance with claim 2 wherein each position is assigned first and second position values based upon the sequential position, and wherein a player wins a maximum bonus if the player is dealt a first pair of cards and each card matches the first position value, and if the player is dealt a second pair of cards and each card matches the second position value.

4. A method in accordance with claim 3 wherein the card game is a blackjack-style game and the first pair corresponds to a first hand and the second pair corresponds to a second hand.

5. A method in accordance with claim 4 wherein the first and second hands are played simultaneously.

6. A method in accordance with claim 1 wherein the game is a blackjack-style game and there are six positions, wherein the deck of playing cards comprises 52 cards, and wherein each position is assigned two position values.

7. A method in accordance with claim 6 wherein a first position has a first position value of ace and a second position value of two, a second position has a first position value of three and a second position value of four, a third position has a first position value of five and a second position value of six, a fourth position has a first position value of seven and a second position value of eight, a fifth position has a first position value of nine and a second position value of ten, and a sixth position has a first position value of one of jack, queen or king and a second position value of one of jack, queen or king.

8. A method in accordance with claim 7 wherein a player wins a maximum bonus if the player is dealt a first and second pair of cards and each card of the first pair matches the player's corresponding first position value, and each card of the second pair matches the player's corresponding second position value.

9. A method in accordance with claim 7 wherein a player wins a bonus if the player is dealt a first and second pair of cards and at least three of the cards matches the player's corresponding position values.

10. A method in accordance with claim 7 wherein a player wins a bonus if the player is dealt a first and second pair of cards and at least one card in the player's first pair matches the player's first position value, and at least one card in the player's second pair matches the player's second position value.

11. A method in accordance with claim 7 wherein a player wins a bonus if the player is dealt a first and second pair of cards and at least one card matches one of the player's corresponding position values.

12. A method in accordance with claim 7 wherein a player wins a bonus if the player is dealt a first and second pair of cards and at least one card matches one of the player's corresponding position values.

13. A method in accordance with claim 1 wherein in order to qualify for a bonus, a player must place a side bet.

14. A method in accordance with claim 1 wherein the game is played on a gaming machine.

15. A method in accordance with claim 1 wherein the game is a poker-style game and there are six positions, and wherein each position is assigned two position values.

16. A method in accordance with claim 15 wherein a first position has a first position value of ace and a second position value of two, a second position has a first position value of three and a second position value of four, a third position has a first position value of five and a second position value of six, a fourth position has a first position value of seven and a second position value of eight, a fifth position has a first position value of nine and a second position value of ten, and a sixth position has a first position value of one of jack, queen or king and a second position value one of jack, queen or king.

17. A method in accordance with claim 16 wherein a player wins a maximum bonus if the player is dealt a first hand and at least one card of the first hand matches the player's corresponding first position value, and is dealt a second hand and at least one card of the second hand matches the player's corresponding second position value.

18. A method in accordance with claim 16 wherein a player wins a bonus if the player is dealt a first and second pair of cards and at least three of the cards matches the player's corresponding position values.

19. A method in accordance with claim 16 wherein a player wins a bonus if the player is dealt a first and second pair of cards and at least one card in the player's first pair matches the player's first position value, and at least one card in the player's second pair matches the player's second position value.

20. A method in accordance with claim 15 wherein in order to qualify for a bonus, a player must place a side bet.

21. A method in accordance with claim 15 wherein the game is played on a gaming machine.

22. A method of playing a card game, the method comprising:

providing at least one deck of playing cards, said deck comprising four suits;

dealing a predetermined number of cards constituting a hand to at least one player and at least one up-card to a house;

assigning a bonus value based upon the at least one up-card dealt to the house; and determining if a player is entitled to a bonus based upon at least one dealt card in the player's hand matching at least one assigned bonus value.

23. A method in accordance with claim 22 wherein the game is a blackjack style card game, wherein two hands are played by players and the house, wherein an up-card of a first hand of the house determines a first bonus value and an up-card of a second hand of the house determines a second bonus value, and wherein a player wins a maximum bonus if the player is dealt a first pair of cards and each card matches the first bonus value, and if the player is dealt a second pair of cards and each card matches the second bonus value.

24. A method in accordance with claim 23 wherein a player wins a bonus if the player is dealt the first and second pair of cards and at least three of the cards matches the bonus values.

25. A method in accordance with claim 23 wherein a player wins a bonus if the player is dealt the first and second pair of cards and at least two of the cards matches the bonus values.

26. A method in accordance with claim 23 wherein a player wins a bonus if the player is dealt the first and second pair of cards and at least one of the cards matches the bonus values.

27. A method in accordance with claim 22 wherein in order to qualify for a bonus, a player must place a side bet.

28. A method in accordance with claim 22 wherein the game is played on a gaming machine.

29. A method in accordance with claim 22 wherein one bonus value is assigned based upon one up-card dealt to the house.

30. A method in accordance with claim 29 wherein a player wins a bonus if one of his cards matches the bonus card.

31. A method in accordance with claim 29 wherein a player wins a bonus if one of their first two cards matches the bonus card.

32. A method in accordance with claim 29 wherein a player wins a bonus if both of their first two cards matches the bonus card.

33. A method in accordance with claim 29 wherein the game is a blackjack style card game, wherein two hands are played simultaneously by players against one hand dealt to the house, and wherein a player wins a maximum bonus if the player is dealt a first pair of cards and each card matches the bonus value, and if the player is dealt a second pair of cards and each card matches the bonus value.

34. A method in accordance with claim 22 wherein the game is a poker-style game.

35. A method in accordance with claim 34 wherein two hands are played by players and the house, wherein an up-card of a first hand of the house determines a first bonus value and an up-card of a second hand of the house determines a second bonus value.

36. A method in accordance with claim 35 wherein a player wins a maximum bonus if the player is dealt a first hand and at least one card matches the first bonus value, and is dealt a second hand and at least one card of the second hand matches the second bonus value.

37. A method in accordance with claim 35 wherein a player wins a bonus if the player is dealt a first and second pair of cards and at least three of the cards matches the bonus values.

38. A method in accordance with claim 35 wherein a player wins a bonus if the player is dealt at least a first and second pair of cards and at least one card in the player's at least first pair matches the first bonus value, and at least one card in the player's at least second pair matches the second bonus value.

39. A method in accordance with claim 35 wherein in order to qualify for a bonus, a player must place a side bet.

40. A method in accordance with claim 35 wherein the game is played on a gaming machine.

* * * * *